US008950122B2

(12) United States Patent
Degenhardt et al.

(10) Patent No.: US 8,950,122 B2
(45) Date of Patent: Feb. 10, 2015

(54) COVERED GUTTER WITH BI-DIRECTIONAL VERTICAL PLATE

(71) Applicants: Claire Degenhardt, Cincinnati, OH (US); Keith Hansen, Longmont, CO (US); Frank Casares, Erie, CO (US)

(72) Inventors: Claire Degenhardt, Cincinnati, OH (US); Keith Hansen, Longmont, CO (US); Frank Casares, Erie, CO (US)

( * ) Notice: Subject to any disclaimer, the term of this patent is extended or adjusted under 35 U.S.C. 154(b) by 0 days.

(21) Appl. No.: 13/872,113

(22) Filed: Apr. 28, 2013

(65) Prior Publication Data

US 2014/0318030 A1 Oct. 30, 2014

(51) Int. Cl.
*E04D 13/00* (2006.01)
*E04D 13/076* (2006.01)

(52) U.S. Cl.
CPC ..... *E04D 13/076* (2013.01)
USPC ..... 52/12; 52/13; 52/14; 52/15; 52/16

(58) Field of Classification Search
USPC ..... 52/11–16
See application file for complete search history.

(56) References Cited

U.S. PATENT DOCUMENTS

| | | | | |
|---|---|---|---|---|
| 4,142,370 | A * | 3/1979 | Giordano | 405/119 |
| 4,190,988 | A * | 3/1980 | Carreiro | 52/16 |
| 5,437,138 | A * | 8/1995 | Tuohey et al. | 52/741.1 |
| 5,529,436 | A * | 6/1996 | Meyers | 405/119 |
| 5,617,678 | A * | 4/1997 | Morandin et al. | 52/11 |
| 6,027,283 | A * | 2/2000 | Schweinberg et al. | 405/42 |
| 6,540,437 | B1 * | 4/2003 | Larson | 405/90 |
| 6,931,792 | B2 * | 8/2005 | McDonald et al. | 52/12 |
| 7,117,642 | B2 * | 10/2006 | Brown | 52/11 |
| 7,117,643 | B2 * | 10/2006 | Brown | 52/12 |
| 7,624,541 | B2 * | 12/2009 | Gentry | 52/12 |
| 8,176,687 | B2 * | 5/2012 | Roque Alonso | 52/12 |
| 8,225,556 | B2 * | 7/2012 | Brown | 52/12 |
| 2005/0115158 | A1 * | 6/2005 | Brown | 52/11 |

* cited by examiner

*Primary Examiner* — Mark Wendell
(74) *Attorney, Agent, or Firm* — R. Christian Macke

(57) ABSTRACT

A covered gutter assembly utilizing bi-directional vertical plates and a bi-directional vertical plate. A gutter trough and hood are secured to either or both sides of the bi-directional vertical plate, so that only a single design for the vertical plate is required for right end or left end terminations. Provisions for securing the hood and the trough to the vertical plate are provided as mirror images on opposed sides of the vertical plate. The bi-directional vertical plate is provided with channels that extend substantially around the entire perimeter of the vertical plate, and which further include guide slopes and reduced locking channels to assure precise securing of the trough and hood to the vertical plate.

8 Claims, 10 Drawing Sheets

150
10X
16S
20
16

150
10X
16S
20
16

150
10X
16S
20
16

102
14
18
20
22
24
27
30
100
110
18
16
32
34
36
38
60
12
25
L
R
10
252
254
260

COVERED GUTTER WITH BI-DIRECTIONAL VERTICAL PLATE

FIELD OF THE INVENTION

The present invention relates to a covered rain gutter having a hood that covers the gutter trough and prevents leaves and other debris from entering the gutter trough and thereby prevents gutter clogging. The present invention particularly relates to a covered rain gutter utilizing bi-directional vertical plates to which the gutter and hood are secured.

BACKGROUND OF THE INVENTION

Rain gutters are provided on virtually every structure to catch rain runoff from the structure's roof. Generally, gutters are open troughs provided along the edge of the roof of the structure such that they catch the surface water runoff from the roof. Gutters are generally connected to a fascia board under the edge of the roof with downspouts connected to low points of the gutter to collect and carry away the roof water runoff and direct it away from the structure.

Rain gutters are generally U-shaped with a rear vertical wall, a bottom horizontal base, and a front substantially vertical wall. A common problem with gutters so formed that are left open is that, in addition to the rainwater runoff that they are intended to collect, they will collect undesirable wind-blown and runoff debris, including leaves and bits of broken shingles coming from the roof. This collection of leaves and other debris within a gutter quickly leads to gutter and downspout clogging, causing water collected in the trough to overflow. Removal of the debris and leaves is necessary to stop the overflowing, and has become a regular maintenance chore for many property owners.

A number of prior art arrangements have been developed to eliminate the necessity of cleaning gutters to prevent blockage by leaves and debris. A number of prior art devices and methods used a screen or mesh material installed on top of the gutter trough. The nature of the screen or mesh is that it is porous to allow water to pass through into the gutter trough while still preventing leaves and other debris from entering the gutter.

Another approach that has been developed to block the entry into gutters of leaves and debris is a cover that overlies the gutter top opening. The cover is intended to serve as a deflector of leaves and other debris so that they either are blown off the cover by the wind, or they fall over the front edge of the gutter while allowing the rain water to flow over the outer edge of the cover and into the gutter for collection and disposal. Although several approaches to configuring and supporting a gutter cover have been disclosed, those approaches are cumbersome and time consuming from an installation standpoint, are costly in terms of amount of attachment materials needed, and are not particularly rigid in terms of the rigidity of the overall gutter structure or the rigidity of its attachment to a building surface.

Some of the prior art solutions to prevent gutter clogging by leaves and debris provide a solid cover that overlies the gutter top opening. In those arrangements, the gutter cover acts as a hood preventing leaves and other debris from entering the gutter. A number of gutter trough and hood arrangements have been successful, although not without problems and disadvantages. In general, the prior art covered gutter arrangements were complicated and labor intensive to install, because support members or brackets were required to secure and support the end caps, the end caps being provided at the ends of the trough to prevent any water from escaping out the end of the trough. In prior art devices, the end caps have been attached to the trough through various methods. In U.S. Pat. Nos. 7,117,642 and 7,117,643, for example, an arrangement is provided wherein a covered gutter trough is provided with an end plate that screws into a bracket that is positioned within the trough to maintain separation between the trough and cover. These patented arrangements are disadvantageous because they require brackets near the end plates, a separate right or left end plate is required for the two ends of the trough, and there is no welded or mechanical connections between the end plates and the gutter. The connection to an adjacent bracket is only good and reliable as the bracket being mounted in the trough, and the screw connection to the bracket reflected in the '642 and '643 patents itself creates a number of problems. Mechanically, the screws and sleeves are frequently stripped, leaving the connections loose and difficult to maintain. In addition, the provision of separate right and left end plates is a problem because frequently parts and products are shipped with the wrong number or mix of right and left end caps, or if one failed there we was no way to use the other end cap. The end caps provided in the prior art patented arrangements were strictly right or left end caps and connected to brackets mounted in the trough. Overtightening or misalignment of the screws holding the end cap to the bracket results in weakened or failed end caps, leading to leakage out of the end of the trough, water flowing out through a damaged end plate instead of into a downspout as desired. In addition, even in those instances in which the end plate is successfully attached to the bracket with screws, it is connected at only two points, and the edge of the gutter trough is butted up against the end cap and there is no mechanical connection between the end caps and the brackets.

There is thus identified a need for a covered gutter system and, in particular for a vertical plate used with a covered gutter system that solves the problems associated with the prior art. It is desirable to provide a vertical plate that does not require screwing to a bracket, that is mechanically connected to the gutter trough, and that has the provisions that it is bi-directional so that a single style can be used as either the left end plate or the right end plate.

OBJECTS OF THE INVENTION

It is an object of the present invention to provide a covered gutter system having a single style of bi-directional vertical plates that may be used as a right end plate or left end plate or as a splice plate.

It is another object of the present invention to provide a covered gutter system wherein the end plates are mechanically secured to the gutter trough.

It is yet another object of the present invention to provide a covered gutter assembly wherein the vertical plates are provided with finished exterior faces in both directions so they can be used as right or left end caps.

It is another object of the present invention to provide a bi-directional vertical plate for a covered gutter system fabricated from a single piece of homogeneous material.

It is yet another object of the present invention to provide a bi-directional vertical plate for a covered gutter system having provisions for locking a trough and hood into place on the vertical plate.

It is yet another object of the present invention to provide a bi-directional vertical plate for a covered gutter system with provisions to be used as a splice plate facilitating unions of terminating ends of covered gutters.

It is yet another object of the present invention to provide a bi-directional vertical plate for a covered gutter system having a mechanical connection around substantially the full perimeter where the trough engages the bi-directional vertical plate.

It is another object of the present invention to provide a covered gutter system wherein bi-directional vertical plates receive trough corner sections in a face opposite that in which it receives a length of gutter trough.

SUMMARY OF THE INVENTION

The present invention comprises a covered gutter assembly having a gutter trough and a hood covering the gutter trough. A bi-directional vertical plate is provided with means for securing the gutter trough to either a left face or a right face of the bi-directional vertical plate. In the most preferred embodiment, the means for securing comprises a trough channel on a left face of the bi-directional vertical plate and a trough channel on a right face of the bi-directional vertical plate.

The bi-directional vertical plate of the present invention is constructed from a single piece of material, either molded or machined, and has finished exterior surfaces on both sides. That is, either during or subsequent to the mold forming or machining of the vertical plate, the right face and left face are both finished with attractive texturing or embossed with verbiage or indicia visible regardless of which face, the right or left, is visible after installation.

In addition to the attachment of the gutter trough to the bi-directional vertical plate, also provided are means for securing the hood to either a right face or a left face of the bi-directional vertical plate.

For all aspects of the present invention it is critical that the left face trough channel and the right face trough channel are mirror images of each other separated by a solid center section. The trough channels on both the right face and left face of the bi-directional vertical plate extend substantially the entire length of the rear vertical plate, the base and the front vertical wall.

DETAILED DESCRIPTION OF THE INVENTION

Figure 1:
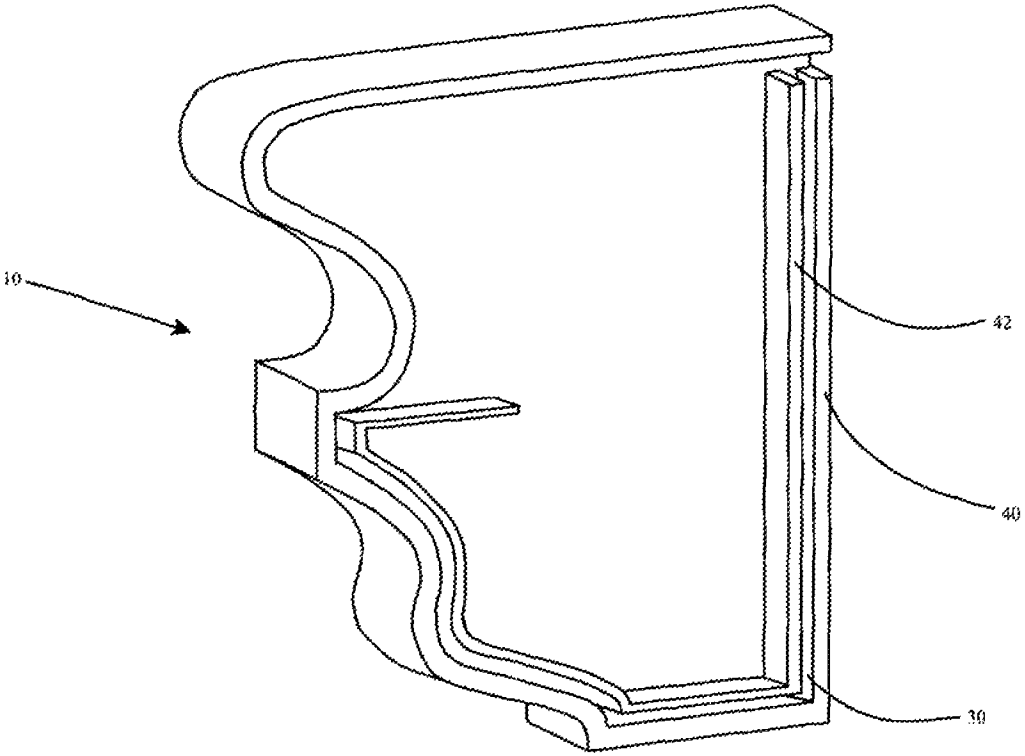
FIG. 1 is a perspective view of the bi-directional vertical plate of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention and is made merely for the purpose of providing a full and enabling disclosure of the present protection. The detailed disclosure herein of one or more embodiments is not intended, nor is to be constructed, to limit the scope of patent protection afforded the present invention, which scope is to be defined by the claims and the equivalents thereof. It is not intended that the scope of the patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods are not limited to being carried out in any particular sequence or order, absent an indication otherwise. Indeed, the steps in such process or methods generally may be carried out in various different sequences and orders while still falling within the scope of the present invention. Accordingly, it is intended that the scope of the patent protection afforded the present invention is to be defined by the appended claims rather than the description set forth herein.

Additionally, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to a "picnic basket having a single apple" describes "a picnic basket having only one apple."

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." in contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese and crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Figure 10:
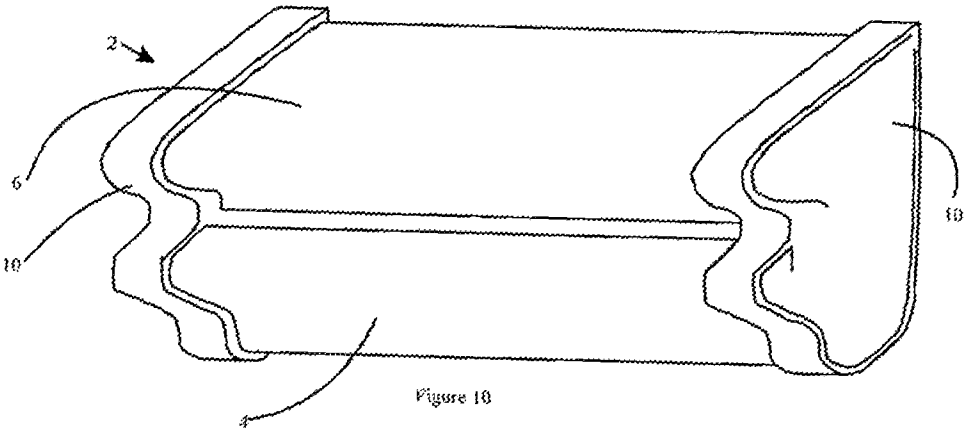
FIG. 10 is a perspective view of a covered gutter assembly comprising a trough and hood secured between two bi-directional vertical plates in accordance with the present invention.
Figure 12B:
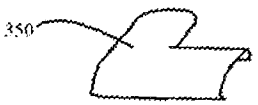
FIG. 12B is a covered gutter hood corner section fabricated to engage bi-directional vertical plates in both directions.
Figure 12A:
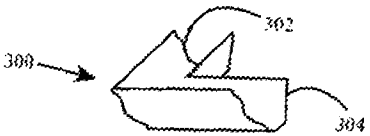
FIG. 12A is a covered gutter trough corner section fabricated to engage bi-directional vertical plates in both directions.

The present invention, as shown in the drawings utilizing reference numbers, addresses the limitations and disadvantages of the prior art. A covered gutter system 2 shown generally in FIG. 10 is provided wherein a gutter trough 4 and hood 6 are disposed between identical bi-directional vertical plates 10. The bi-directional vertical plates 10 are homogeneous and constructed from a single piece of material for strength, integrity and aesthetic appearance. Preferably, the bi-directional vertical plates are molded plastic with finished exterior surfaces facing both directions. That is to say, regardless of whether the left side or the right side of the vertical plate 10 is exposed at the end of a gutter trough, the outward face will have a finished appearance, which may include, without limitation, a textured surface or embossed logo or verbiage.

Figure 2B:
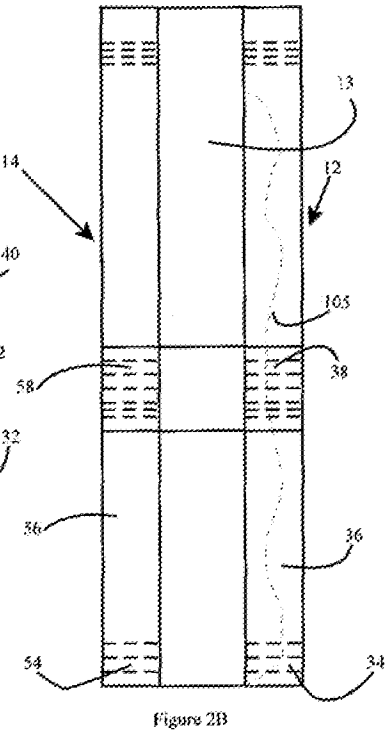
FIG. 2B is a side view of the bi-directional vertical plate of the present invention.
Figure 2A:
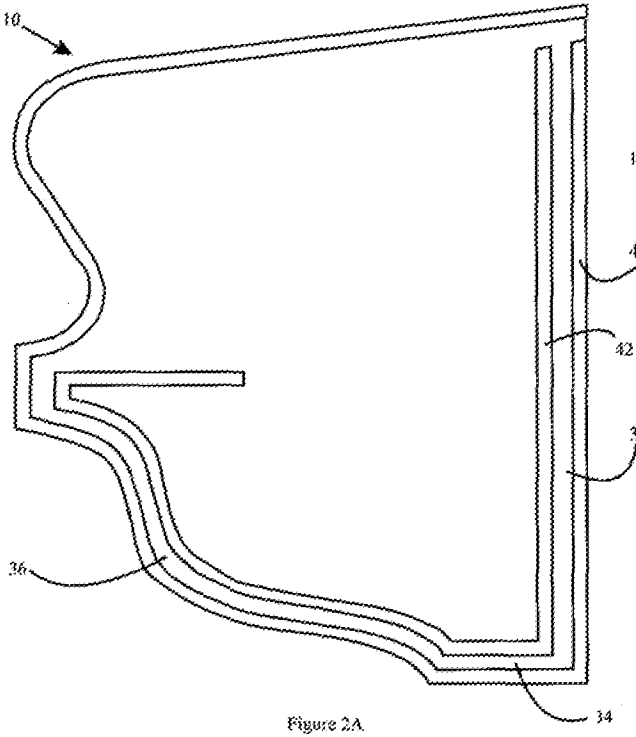
FIG. 2A is a front view of the bi-directional vertical plate of the present invention.

Means for securing a gutter trough 4 to the bi-directional vertical plates 10 are provided on both the right face 12 and left face 14 of the vertical plates 10, the right face 12 and left face 14 being mirror images of each other and separated by a solid center section 13 (see FIGS. 1, 2A, 2B).

Figures 7A, 7B:
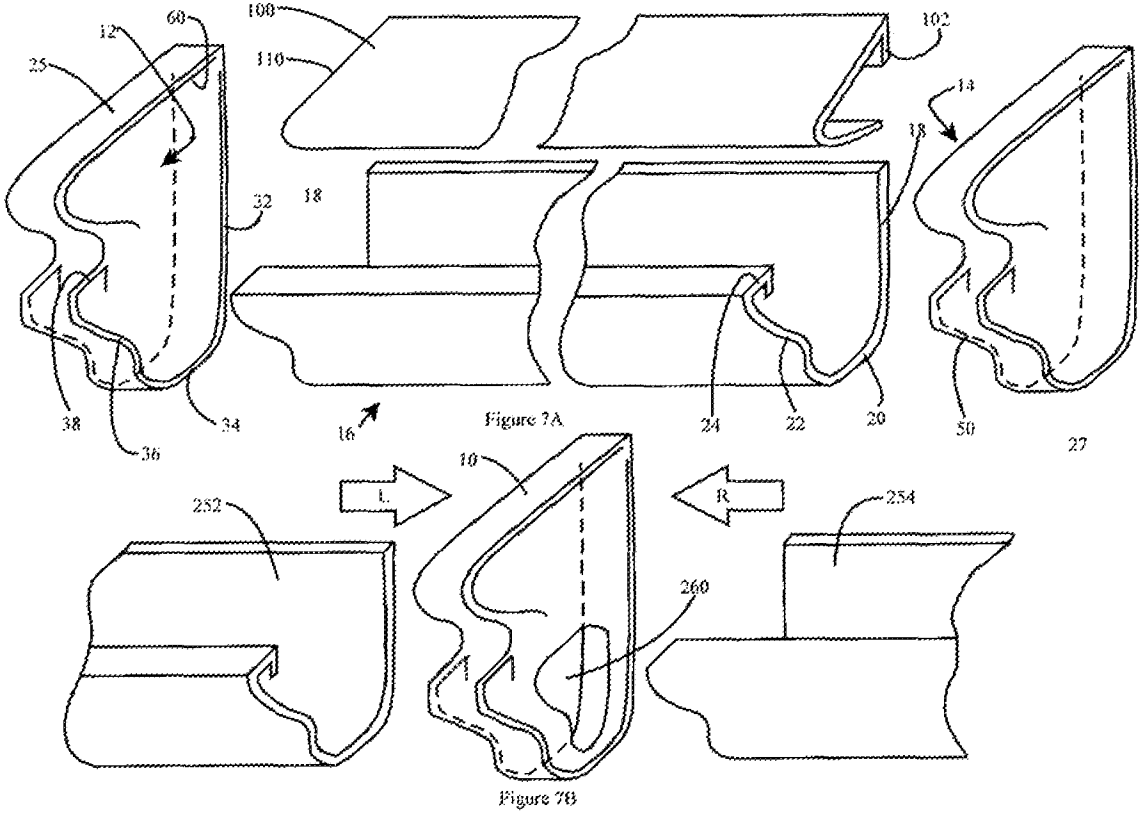
FIG. 7A is a schematic view illustrating the dual use of the vertical plate as a right end cap or a left end cap.
FIG. 7B is a schematic view illustrating the dual use of the vertical plate of the present invention as a splice junction plate with a knockout section removed.
Figure 8:
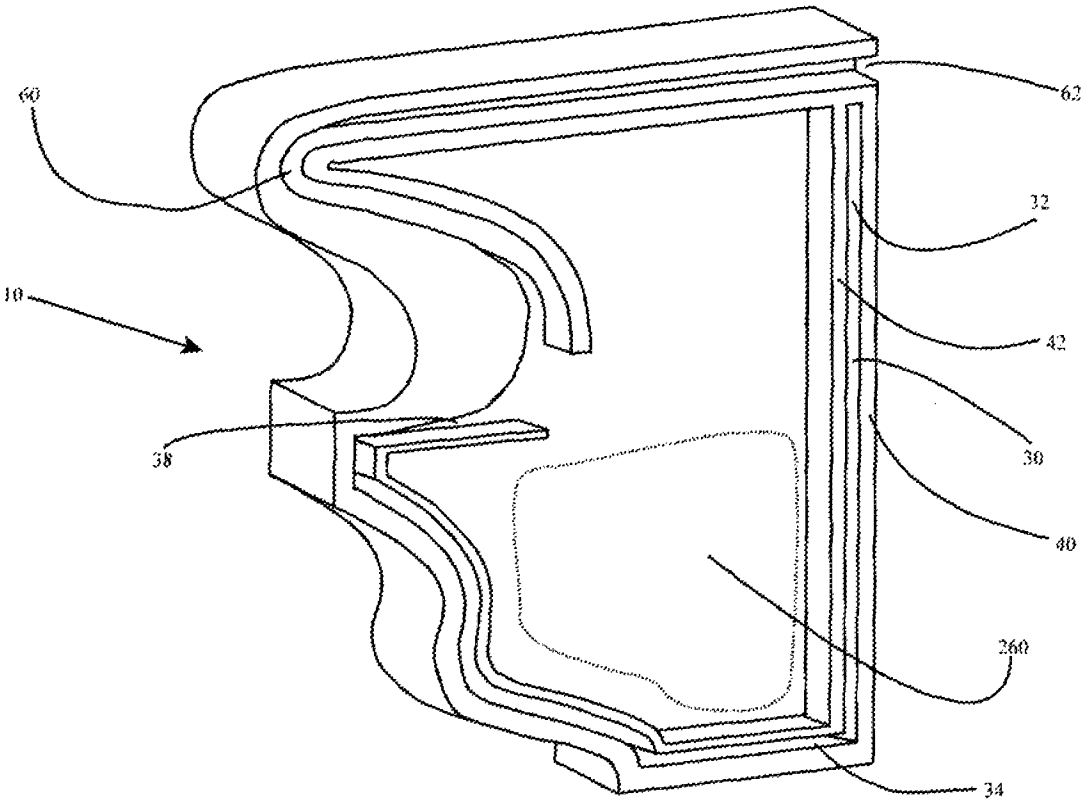
FIG. 8 is a perspective view of the vertical plate of the present invention illustrating the presence of scoring for a knockout section.
Figure 9:
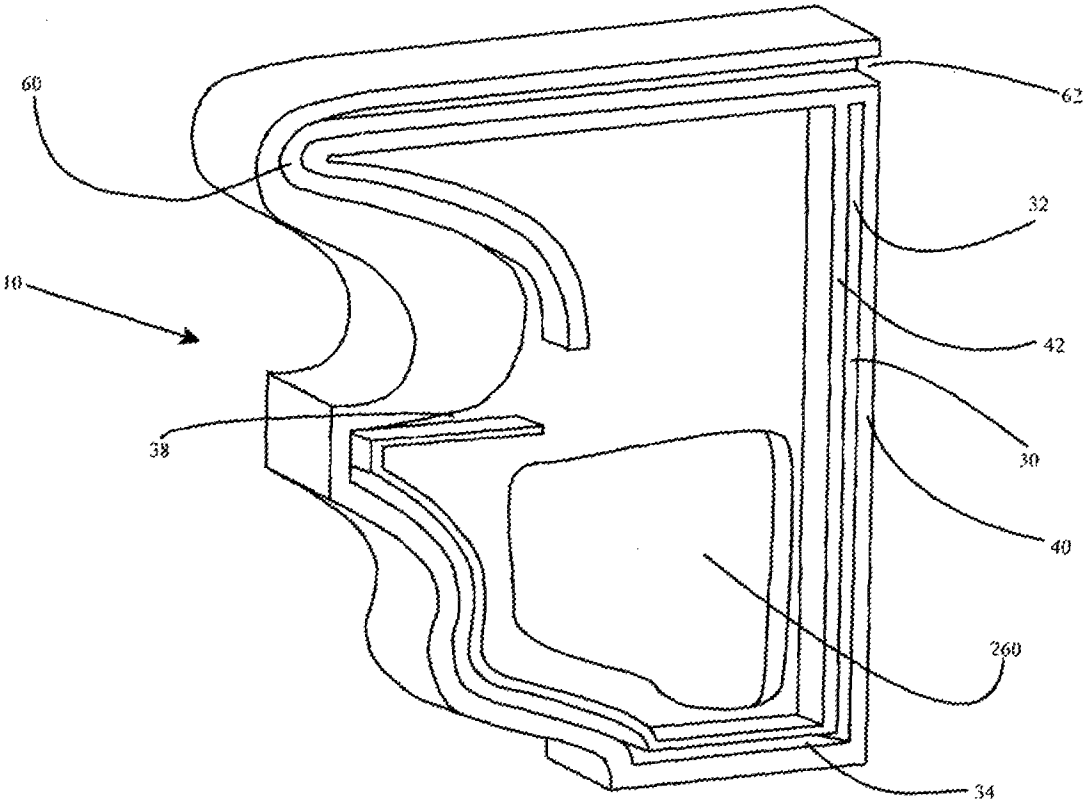
FIG. 9 is a perspective view of the vertical plate of the present invention shown with a knockout section removed.

The bi-directional vertical plates 10 are designed to receive on either side a gutter trough 16 having a terminal edge comprising a substantially U shaped member having a rear vertical wall 18, a bottom horizontal base 20, a front vertical wall 22 and a horizontal lip 24. As shown in FIG. 7A, the trough 16 is secured to the right face 12 of a bi-directional vertical plate 25 by engaging and being retained in a gutter channel 30 that is formed on the vertical plate 25. The gutter channel 30 comprises a vertical section 32 extending substantially the entire height of the vertical plate 25, a bottom horizontal section 34, a front substantially vertical curvilinear section 36 and an upper horizontal section 38. The length of the gutter channel 30 is defined by and between an outer channel wall 40 and an inner channel wall 42 extending parallel to the outer channel wall 40, the length and shape of the channel 30 being determined to cooperatively receive the entire edge of the trough 16 defined by rear vertical wall 18, horizontal base 20, front substantially vertical wall 22 and horizontal lip 24. The vertical plate 25, and channels 30, 32, 34, 36, 38 are sized and shaped to cooperatively receive a preformed gutter trough 16 therein.

As shown in FIG. 7A, the end of the trough 16 opposite that engaging the right face 12 of vertical plate 25 engages the left face 14 of a second vertical plate 27. Specifically, the trough 16 is received in trough channel 50 on the left face 14 of bi-directional plate 27, the mirror image of trough channel 30 on vertical plate 25. As described supra, the bi-directional plates 25, 27 are identical, with both having mirror image provisions for receiving opposed ends of the gutter trough 16. It is a critical feature of the present invention that the bi-directional vertical plates 25, 27 are provided with mirror image channels 50, 52, 54, 56, 58 on the left face 14, on the other side of solid center section 13 from the right face 12 having channels 30, 32, 34, 36, 38. It is the objective of the inventors herein to provide a singular design for both vertical plates 25, 27 that allow them to receive a gutter trough 16 on the right face 12, left face 14, or both faces 12, 14. The bi-directional vertical plates 25, 27 of the present invention are provided with finished, aesthetically pleasing surfaces on both the right face 12 and left face 14.

By providing a single design for the bi-directional vertical plate 10, accommodating use as a left end cap or right end cap with mirror image faces 12, 14, installation and repair are improved because the situation is removed wherein right end caps or left end caps are missing or shipped in the wrong quantity, or damaged or defective, delaying installation until such time as the correct parts can be shipped. The use of the bi-directional vertical plate 10 at opposed ends of the covered gutter assembly necessitates that both the right face 12 and left face 14 be provided with finished, aesthetically pleasing surfaces, free of mold marks and machine marks.

Figure 3:
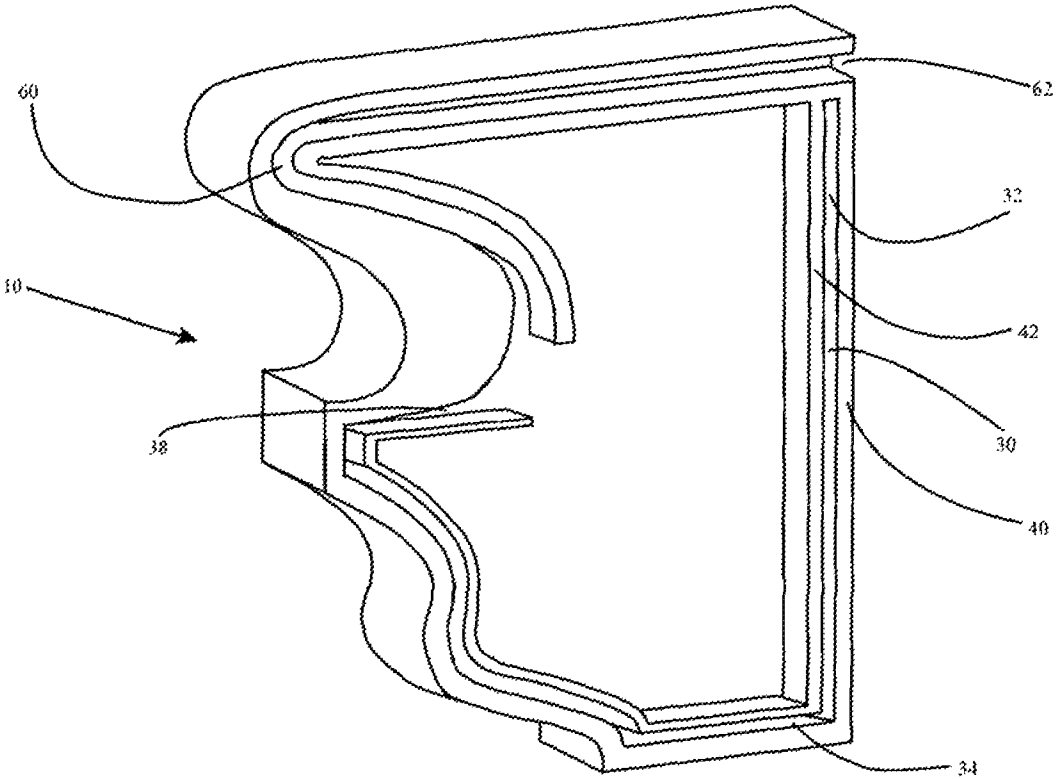
FIG. 3 is a perspective view of the bi-directional vertical plate of the present invention having a hood channel.
Figure 4B:
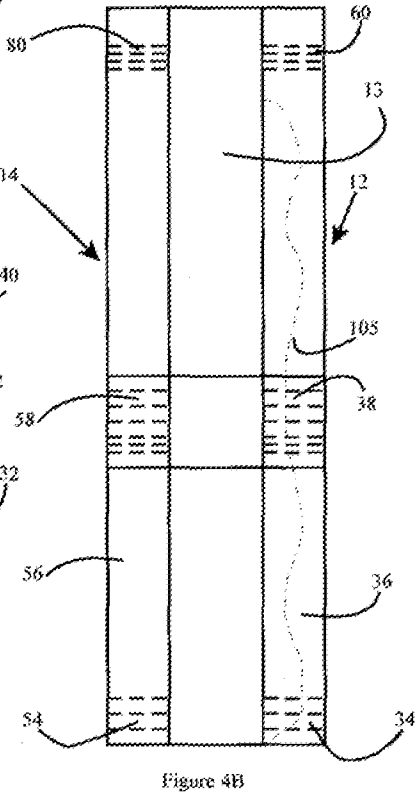
FIG. 4B is a side view of the bi-directional vertical plate of the present invention having a hood channel.
Figure 4A:
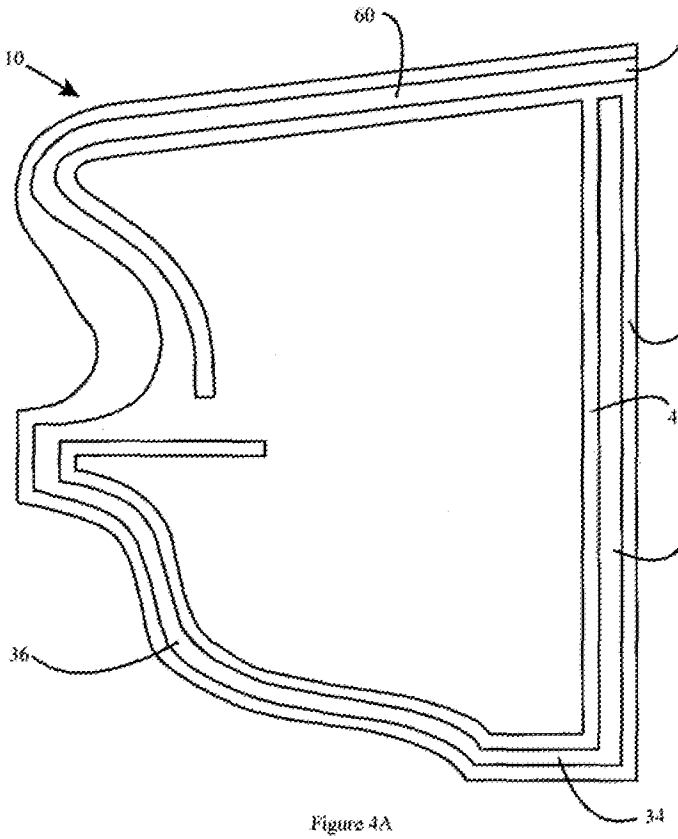
FIG. 4A is a front view of the bi-directional vertical plate of the present invention having a hood channel.

In addition to the right face gutter channel 30 and left face gutter channel 50, the bi-directional plates 25, 27 may be formed with bi-directional means for receiving the gutter cover hood on both sides as well comprising a hood channel 60 on the right face 12 and a hood channel 80 on the left face 14 (see FIGS. 3, 4A, 4B). After the gutter 16 is secured within either right gutter channel 30 or left gutter channel 50, a hood 100 (see FIG. 7A) may be positioned within an upper corresponding hood channel 60, 80. Provision in the vertical plate 10 is made for an extension of the hood 100 therethrough, provided in the most preferred embodiment by a vertical extension 102 of the hood 100 extending through gap 62 in the outer channel wall 40 (see FIGS. 3, 4A, 4B). It is specifically contemplated, however, that the hood extension 102 may be upward depending, horizontal or downward depending, and any such modification is within the scope of the present invention.

Thus a bi-directional vertical plate 25 of the style of vertical plate 10 receives a gutter trough 16 and hood 100, shown in an exploded view at FIG. 7A. The gutter channel 30 provide receptive spaces for the edge of the trough 16 defined by the rear vertical wall 18, bottom horizontal base 20 and front vertical wall 22. The means to positively mechanically affix the trough edge to the vertical plate 10 is provided by a bead of quick set bonding caulk 105, inserted into the gutter channel 30 prior to insertion of the edge of the trough 16 therein. Insertion of bonding caulk 105 in a channel, followed quickly by insertion of the gutter trough or hood, will, after a brief set up time, result in the trough or hood being welded, mechanically affixed to the vertical plate 10. The caulk 105 bonds the trough 16 or hood 100 to the vertical plate 10, while also providing a liquid tight seal therebetween, a critical requirement of any caulk used in this application to prevent leakage out of the end of the gutter trough 16. While a wide variety of bonding caulks may be used to bind the trough 16 within the channel 30, or hood 100 within the channel 60, and are contemplated by the principles of the present invention, in the most preferred embodiment of the present invention Dow Corning® 795 Silicone Building is the caulk that is used to secure and seal the trough 16 in the gutter channel 30.

Similarly, the edge 110 of the hood 100 is positioned within the hood channel 60 during assembly of the covered gutter assembly. Also similar to the installation of the trough 16, prior to positioning the hood edge 110 into the hood channel 50, a bead of bonding caulk 115 is installed in the hood channel 50. Following the attachment of the trough 16 and hood 100 to the right face of the vertical plate 25, the process is repeated to connect the opposite end of the trough 16 and hood 100 to a left face 14 of a vertical plate 27 (FIG. 7A). It is important to recognize that the bi-directional plates 25, 27 are the same style bi-directional vertical plate 10 and have means formed on both sides thereof to receive the edge of the trough 16. Use of bonding caulk will permanently affix the trough 16 and, individually and optionally, the hood 100 to the vertical plates 25, 27, around substantially the entire perimeter defined around the vertical plate 10 by the gutter channels 30, 50 and hood channels 60, 80. This is a substantial departure from the prior art, that substantially the entire perimeter of the trough 16 and, optionally the hood 100, are positively mechanically affixed and sealed to the bi-directional vertical plates 25, 27.

Figure 5B:
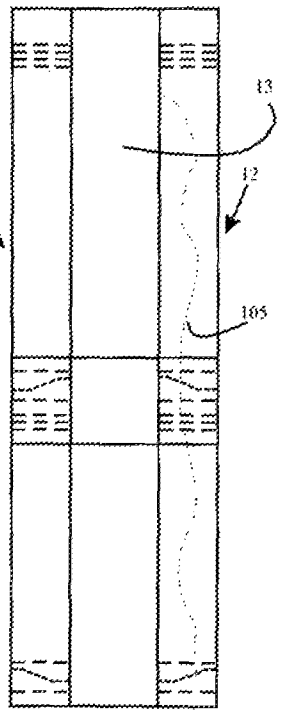
FIG. 5B is a side view of the bi-directional vertical plate having guide surfaces and locking channels formed therein.
Figure 5A:
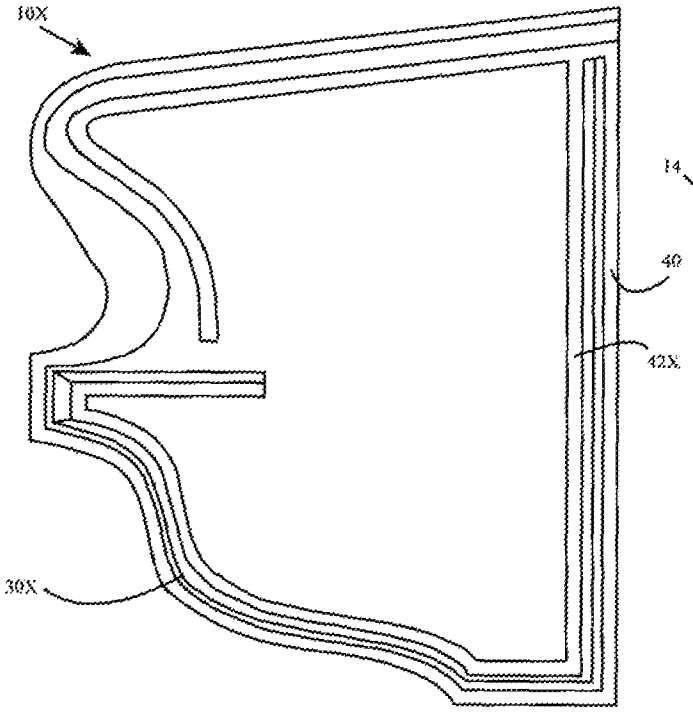
FIG. 5A is a front view of the bi-directional vertical plate having guide surfaces and locking channels formed therein.
Figures 6A, 6B, 6C:
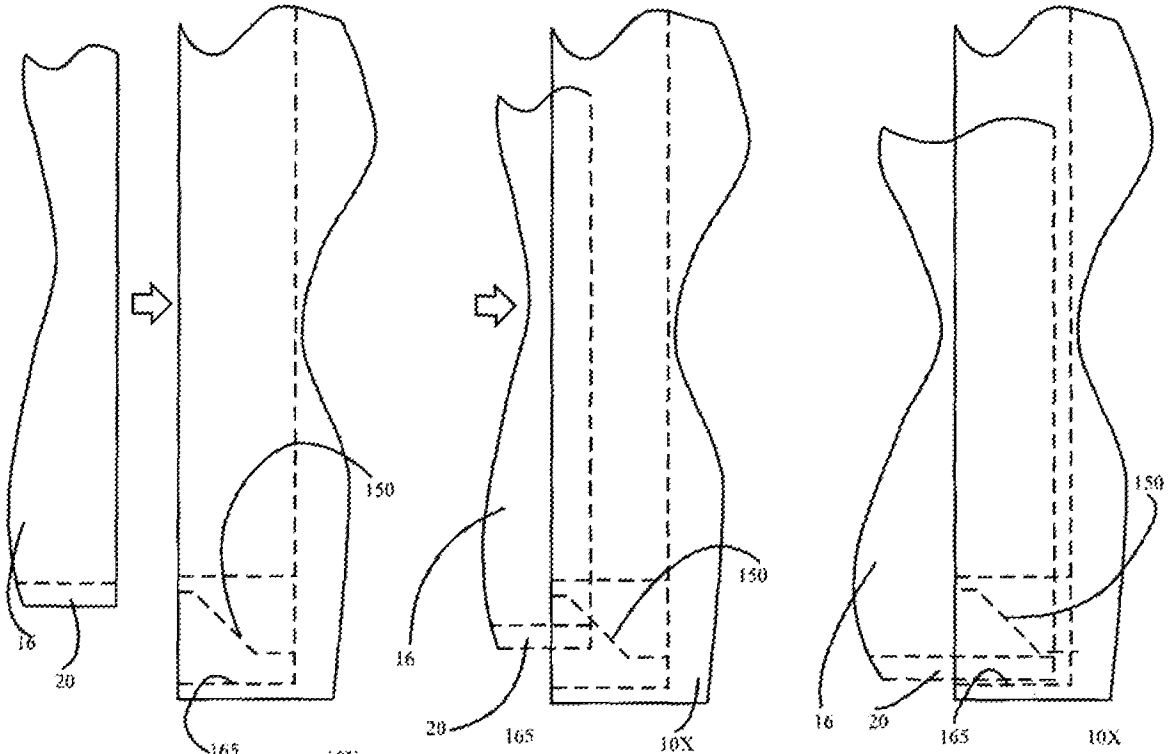
FIG. 6A, 6B, 6C is a progressive illustration of the joinder of the gutter trough with the vertical plate of present invention.

An additional innovation to the affixation of the trough 16 and hood 100 to a vertical plate 10X is provided as shown at FIGS. 6A-6B-6C. In this embodiment, a modified gutter channel 30X is provided wherein the inner channel wall 42X is tapered, as shown in FIGS. 5A-5B and includes a means for precisely guiding the trough 16 into a small pocket 160 providing a tighter fit on the edge of the trough 16. Upon insertion of the edge of the trough 16 into the channel of vertical plate 10X in the direction indicated by the arrow, the edge 16E engages the tapered inner wall 42 and a guide slope 150 such that, for example, the bottom 20 of the trough 16 is pushed down into a reduced width pocket 160 for a tighter fit. The mechanical connection of the trough 16 to the bi-directional vertical plate 10X is enhanced by modifying the mold to provide the modified tapered inner wall 42 to provide the guide slope 150. The gutter channel is nominally provided with a width of 0.185 inches, and the gutter trough 16 has a sheet thickness of 0.032 inches, so there is room for a lot of play of the trough 16 in the channel 30, that is, the 0.032 inches thick trough 16 will be floating within the 0.185 inches wide channel 30. The disadvantageous result is that the trough 16 is not fully seated against the channel wall 40. The present invention utilizes guide slope 150 to force the trough bottom 20, for example, along with other trough walls 18, 22, 24 into reduced width pockets 160 and thereby improves the fit and location of the trough wall 20 against the outer channel face 165 (FIGS. 6A, 6B, 6C). It is important to have the trough 16 disposed in near face to face engagement with the outer channel wall 40 to minimize or eliminate any gap therebetween through which the trough 16 could leak, and to create a tighter, more precise connection and assembly. In short, without a guide slope 150, a sloppier connection with a larger gap between the trough/hood and vertical plates results because, while in the preferred embodiment the trough 14 has a nominal thickness of 0.185 inches, the nominal thickness of the trough sheet material is only 0.032 inches. The reduced width pocket 160 is stepped down from the full channel width of 0.185 inches to no more than 0.500 inches, creating a much tighter and secure fit of the trough 16 in the vertical plate 10X.

The use of the bi-directional vertical plate 10, because it is provided with mirror attachment provisions on both the left face and right face, is also used as a splice plate 200, as shown in FIG. 7B, to join two terminated sections of trough 16. Specifically the bi-directional vertical plate 10 is used to join trough section 252 to trough section 254. The use of the bi-directional vertical plate 10 in this way becomes important if a small section of gutter needs to be added or a section needs to be repaired. That is, in the event a length of gutter trough is improperly cut too short, instead of having to extrude a new long section of trough 16 and tearing out an old section, the use of the bi-directional vertical plate 10 as a splice allows an efficient and economical repair.

Figure 11:
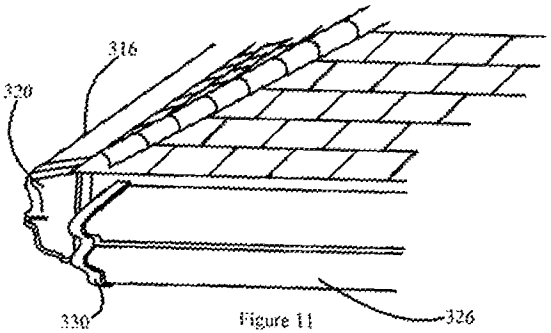
FIG. 11 is a perspective view of a corner section of a roof and two terminated sections of covered gutter assemblies.

In addition to its use as a spice repair device, the use of the bi-directional vertical plate 10 is also used as a corner connector, wherein a pre-fabricated corner 300 having two terminal ends 302, 304 are secured at the corner of a roof (FIG. 11). Installing the corner section 300 between a gutter trough 316, which terminates at a bi-directional vertical plate 320, and a gutter trough 326, which terminates at a bi-directional vertical plate 330, is easily performed because both bi-directional vertical plates 320, 330 have means for securing terminal sections of gutter trough on both the right face and left face. As described supra, gutter trough channels 30, 50 are provided on opposed sides of bi-directional vertical plates 320, 330, providing the means for attachment for the prefabricated gutter corner 300. Similarly, a hood corner 350 is secured to the bi-directional vertical plates 320, 330 in hood channels 60,80, that are provided as mirror images on both sides of the bi-directional vertical plates 316, 326. For use as a splice plate or to provide the attachment to a corner, the bi-directional vertical plate 10 is provided with a scored knockout 260 such that only a small portion of the unitary material of the vertical plate 10 is removed while allowing water to flow through the modified vertical plate 10 with knockout material 260 removed. Removal of the scored knockout provides the means to allow water to flow between sections of gutter trough connected across a bi-directional vertical plate 10. Any water runoff collected in the trough corner 300 will be transmitted through the removed knockout area 260 and communicated to the longer runs of gutter trough 316, 326, where it is transferred to downspouts away from the structure.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto

We claim:

1. A covered gutter assembly comprising:

a gutter trough;

a hood covering said gutter trough;

a bi-directional vertical end plate having a solid center section and means for securing said gutter trough to either a left face or a right face of said bi-directional vertical plate wherein said means for securing comprises a trough channel on a left face of said bi-directional vertical end plate and a trough channel on a right face of said bi-directional vertical end plate.

2. The covered gutter assembly as set forth in claim 1 wherein said bi-directional vertical end plate is constructed from a single piece of material.

3. The covered gutter assembly as set forth in claim 2 having finished exterior surfaces on both sides of said solid center section.

4. The covered gutter assembly as set forth in claim 1 wherein said left face trough channel and said right face trough channel are mirror images separated by said solid center section.

5. The covered gutter assembly set forth in claim 4 wherein said gutter trough channels each comprise a vertical section extending substantially the height of said bi-directional vertical end plate, a bottom horizontal section, and a front substantially vertical curvilinear section and an upper horizontal section.

6. A covered gutter assembly comprising:

a gutter trough;

a hood covering said gutter trough;

a bi-directional vertical end plate having a solid center section and means for securing said gutter trough to either a left face or a right face of said bi-directional vertical plate;

wherein said bi-directional vertical plate further comprises means for securing said hood to either a right face or a left face of a bi-directional vertical end plate, and wherein said means for securing said gutter trough to either a left face or a right face of said bidirectional plate comprise trough channels formed by and between an outer channel wall and an inner channel wall having a length and a shape cooperatively determined to receive an entire edge of said trough and wherein said means for securing said hood to either a right face or a left face of said bi-directional plate further comprises hood channels formed for receiving said hood on either the right face or left face of said bi-directional plate, said hood channels formed by and between an outer channel wall and an inner channel wall, said outer channel wall having a gap wherein a hood extension extends through said gap.

7. The covered gutter assembly as set forth in claim 6 wherein said hood extension is upward depending.

8. The covered gutter assembly as set forth in claim 6 wherein said hood extension is downward depending.

* * * * *